US005155711A

United States Patent [19]

Schwartz

[11] Patent Number: 5,155,711

[45] Date of Patent: Oct. 13, 1992

[54] MOVEMENT SUBASSEMBLY FOR A THREE AND TWO HAND TIMEPIECE USING COMMON PIECE PARTS

[75] Inventor: Herbert Schwartz, Wurmberg, Fed. Rep. of Germany

[73] Assignee: Timex Corporation, Waterbury, Conn.

[21] Appl. No.: 876,170

[22] Filed: Apr. 30, 1992

[51] Int. Cl.[5] ..... G04B 19/04

[52] U.S. Cl. ..... 368/80; 368/220

[58] Field of Search ..... 368/76, 80, 88, 220, 368/228, 299-300, 318

[56] References Cited

U.S. PATENT DOCUMENTS 4,647,218 3/1987 Wuthrich ..... 368/157
4,711,584 12/1987 Tanalana et al. ..... 368/88
4,744,066 5/1988 Schwartz ..... 368/76
4,888,749 12/1989 Schwartz et al. ..... 368/157
4,932,010 6/1990 Perucchi ..... 368/80
5,113,381 5/1992 Sakamoto et al. ..... 368/74

*Primary Examiner*—Vit W. Miska
*Attorney, Agent, or Firm*—William C. Crutcher

[57] ABSTRACT

A movement subassembly adapted for use in either a two hand timepiece or a three hand timepiece, the subassembly having a first set of elements common to both timepieces adapted to cooperate with a second set of components, including at least one intermediate wheel assembly to make up a three hand timepiece movement, the first set also adapted to cooperate with a third set of components, using a different wheel assembly to make a two hand timepiece. The second set components includes a seconds wheel assembly, an intermediate wheel assembly, a third wheel assembly and a once-per-second pulsing integrated circuit. The subassembly frame includes bearings for journaling all of said aforementioned wheel assemblies using a common subassembly.

7 Claims, 7 Drawing Sheets

MOVEMENT SUBASSEMBLY FOR A THREE AND TWO HAND TIMEPIECE USING COMMON PIECE PARTS

BACKGROUND OF THE INVENTION

This invention relates generally to quartz analog electronic timepieces and more particularly to movements for three and two hand timepieces.

Watch manufacturers of quartz analog watches offer three hand timepieces with a sweep second hand, as well as two hand timepieces without a second hand, often used in smaller fashion watches. If a watch manufacturer can use fewer components or piece parts in a timepiece movement, and if a number of these components or pieceparts are common to a number of different types of movements, the savings which can be achieved are significant. This is because the common parts can be manufactured in larger quantities, leading to lower cost. Movements of assemblies can be manufactured in advance suitable for conversion to selected types of movements by adding components which are special only to a particular movement.

One of the problems facing the watch designer who is attempting to design several movements using common elements is that the space for the gear train elements and the choices for arranging the gear train are very limited. Therefore, any alteration of a component often affects other components as well.

Three hand movements for quartz analog timepieces are well known in the art, wherein a stepping motor is pulsed Periodically by an integrated circuit to rotate the stepping motor rotor 180 degrees. The rotor rotation is used to step a sweep second hand once every second, so that it rotates once per minute. The reduction may be accomplished through a gear train by driving a seconds wheel assembly through an intermediate wheel reduction gear. The seconds wheel has a pinion driving a third wheel assembly which drives a center wheel to which the minute hand is attached. The center wheel, through a minute wheel assembly, drives an hour wheel to which an hour hand is attached. Such a movement is seen in my U.S. Pat. No. 4,744,066 issued May 10, 1988, and assigned to the present assignee.

Movements are also well known in the art in which a two hand movement utilizes an integrated circuit supplying pulses at a substantially slower rate, e.g. once per minute to a stepping motor rotor. The stepping motor rotor pinion may drive the center wheel directly, or through a reduction gear sometimes known as an intermediate wheel assembly. Thereafter, the movement gear train is the same as described above. A two-hand movement with rotor driving the center wheel directly is seen in U.S. Pat. No. 4,647,218 issued Mar. 3, 1987, to Paul Wuthrich and assigned to the present assignee.

The prior art movements above require one movement for a three hand timepiece and require a completely different movement for a two hand timepiece. It would be desirable to provide a movement subassembly of common elements, to which special parts or components could be added to provide either a two hand or a three hand timepiece, as desired.

Accordingly, one object of the present invention is to provide a movement subassembly suitable for adapting to a movement for either a three or a two hand timepiece, said subassembly using piece parts common to both movements.

Another object of the invention is to provide for an improved three hand timepiece which is convertible to a two hand timepiece.

Another object of the invention is to provide an improved two hand timepiece which is convertible to a three hand timepiece.

Yet another object of the invention is to provide an improved movement subassembly which maximizes the number of common components for in two hand and three hand timepiece movements, and minimizes the number of special components.

SUMMARY OF THE INVENTION

Briefly stated, the invention is practiced by providing a movement subassembly adapted for use in either a two hand timepiece or a three hand timepiece, said subassembly having a first set of elements common to both timepieces, said first set adapted to cooperate with a second set of components, including at least one intermediate wheel assembly, for a three hand timepiece, said first set also adapted to cooperate with a third set of components, including at least one by-pass wheel assembly, for a two hand timepiece, wherein the improvement comprises a plurality of components in said first set adapted to cooperate either with said second set components or with said third set components.

In the preferred embodiment, the second set components include a second wheel assembly, an intermediate wheel assembly, third wheel assembly and a once-per-second pulsing integrated circuit. The third set components include a by-pass wheel assembly and a once-per-minute pulsing integrated circuit. The adaptation of first set components includes providing bearing means for all of said aforementioned wheel assemblies in a common subassembly.

DRAWING

The invention, both as to organization and method of practice, together with further objects and advantages thereof, will best be understood by reference to the following description, taken in connection with the accompanying drawings, in which:

FIG. 1 is a cross-sectional elevation view of the watch movement subassembly developed from Section line I—I of FIG. 2, FIG. 2 is a plan view of the watch movement subassembly from the bottom or movement side, but having the bridge removed, FIGS. 3 and 4 are cross-sectional elevation views of a three hand movement and a two hand movement respectively, including the bridge and the energy cell, developed along section lines III—III and IV—IV respectively of FIGS. 5 and 6 respectively, FIG. 5 is a plan view of the subassembly of FIG. 1 from the movement side, with bridge removed but having additional components added to complete a movement for a three hand timepiece as shown in the corresponding cross-section of FIG. 3, FIG. 6 is a plan view similar to the subassembly of FIG. 1, with bridge removed but having additional components added to make it into a movement for a two hand timepiece, as illustrated in the corresponding cross-section of FIG. 4, and FIG. 7 is a schematic, developed plan view of gear trains of the respective timepieces, not drawn to scale.

DESCRIPTION OF THE PREFERRED EMBODIMENT

Subassembly of Common Piece Parts

Figure 1:
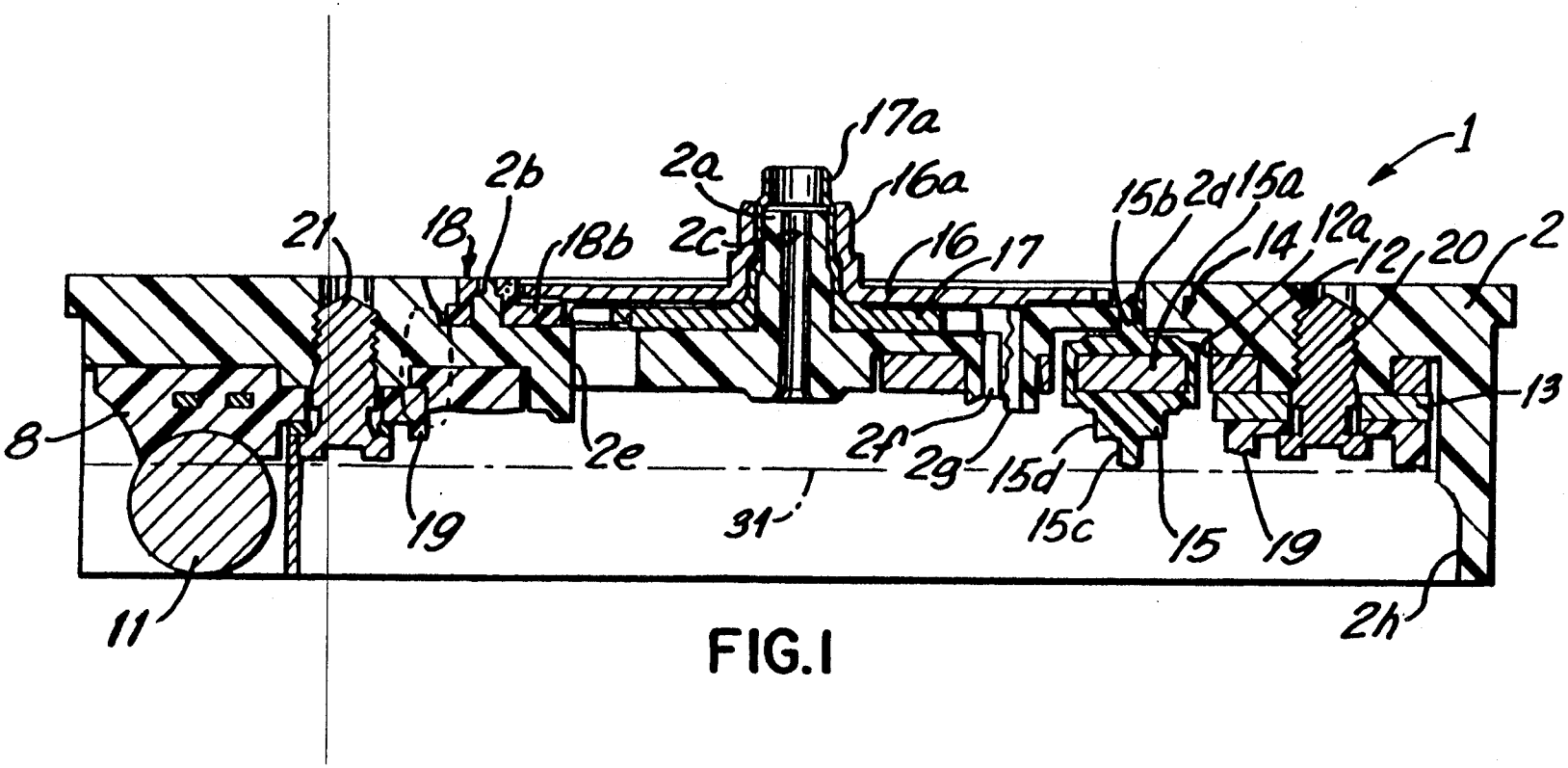
Figure 2:
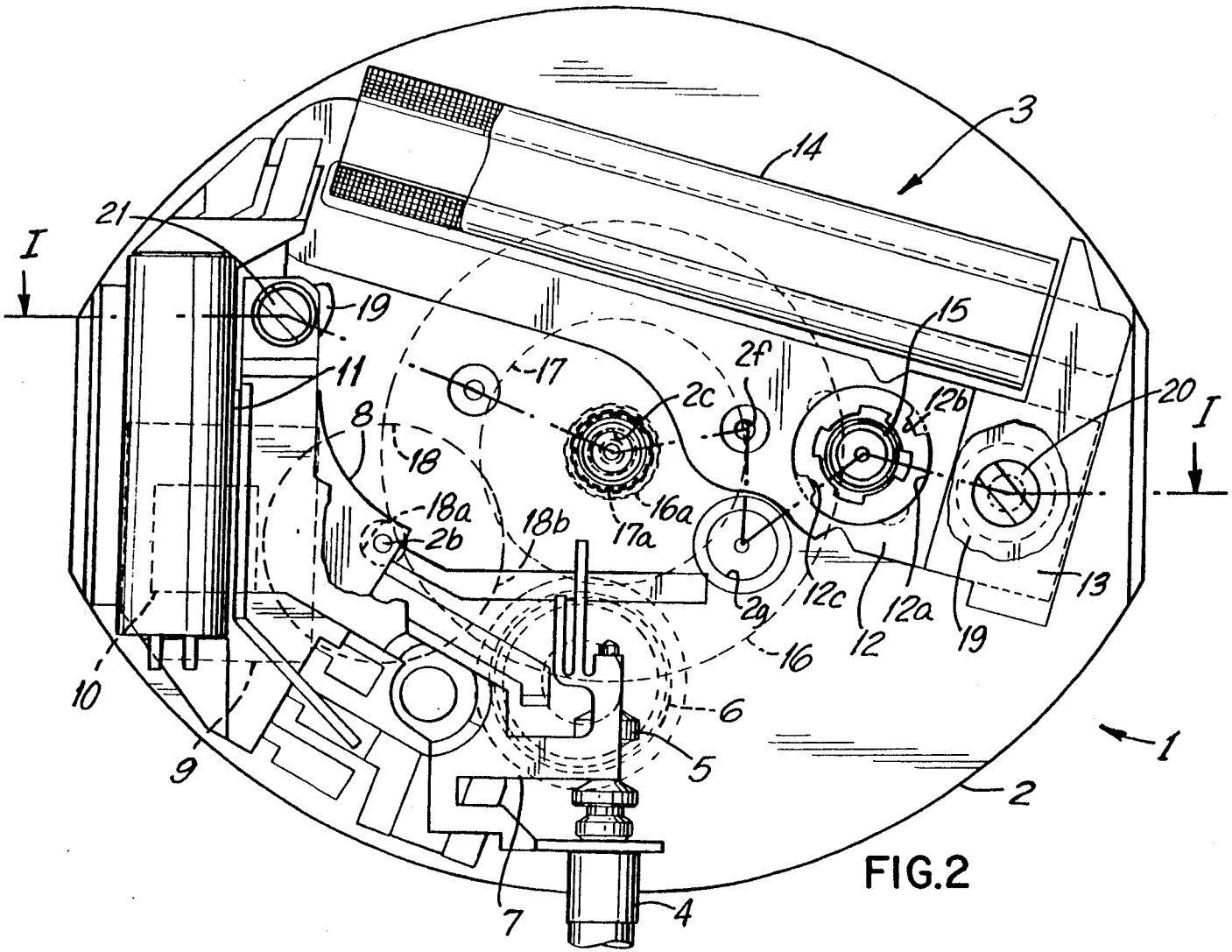

Referring now to FIGS. 1 and 2 of the drawing, most of the elements are shown of a movement subassembly 1 but omitting a plastic bridge except for fragments thereof. The subassembly includes a plastic timepiece frame 2 carrying a "dial-side" gear train shown as dashed circles in the FIG. 2 view and seen more clearly in the cross section of FIG. 1, which is driven by a stepping motor shown generally as 3. A time setting assembly for manually setting the dial-side gear train includes a rotatable, axially slidable setting stem 4 connected to a manually actuatable watch crown (not shown). The setting stem 4 carries a setting pinion 5, and the stem axis is offset with respect to the axis of a time setting wheel 6. Wheel 6 has crown teeth which are engaged by pinion 5 when the stem is Pulled outwardly. The details of the time setting assembly are set forth in Applicant's U.S. Pat. No. 5,083,300 issued Jan. 21, 1992 and assigned to the present assignee. A spring-biased detent spring which also serves as an electrical contact member and braking member for the timepiece is shown at 7. The operation of such a device is outlined in U.S. Pat. No. 4,794,576 issued Dec. 27, 1988 to Schwartz, et al and assigned to the present assignee.

A lead frame 8 comprises a plastic molding with means to mount a circuit board 9 carrying an integrated circuit (IC) 10 and quartz crystal 11. IC 10 provides periodic electric driving pulses in a known manner to the stepping motor 3. The stepping motor is made up of a stator 12 comprising a flat U-shaped member with a bridge 13 forming a closed magnetic path for flux generated by a coil 14 connected to the output of IC 10. A stepping motor rotor 15 comprises a permanent magnet 15*a* overmolded with plastic to provide journals 15*b*, 15*c* and a pinion 15*d*. Rotor 15 rotates or "steps" 180 degrees from a rest position to a new rest position upon receiving an electrical pulse. An opening 12*a* in stator 12 contains the permanent magnet 15*a* within a circumferential air gap and opposed projections 12*b*, 12*c* define the rotor rest position.

The "dial-side" gear train, which may be seen in FIGS. 1 and 2 comprises a toothed hour wheel 16 with an integral hub 16*a* adapted to receive an hour hand (not shown); a coaxial toothed center wheel 17 having an integral hub 17*a* adapted to receive a minute hand (not shown); and a minute wheel assembly 18. The minute wheel assembly 18 has a pinion 18*a* meshing with hour wheel 16, and a toothed wheel 18*b* meshing with center wheel 17. In this manner, when center wheel 17 is driven so as to rotate it once per hour, minute wheel assembly 18 performs a reduction so as to cause hour wheel 16 to rotate once every 12 hours.

Figure 3:
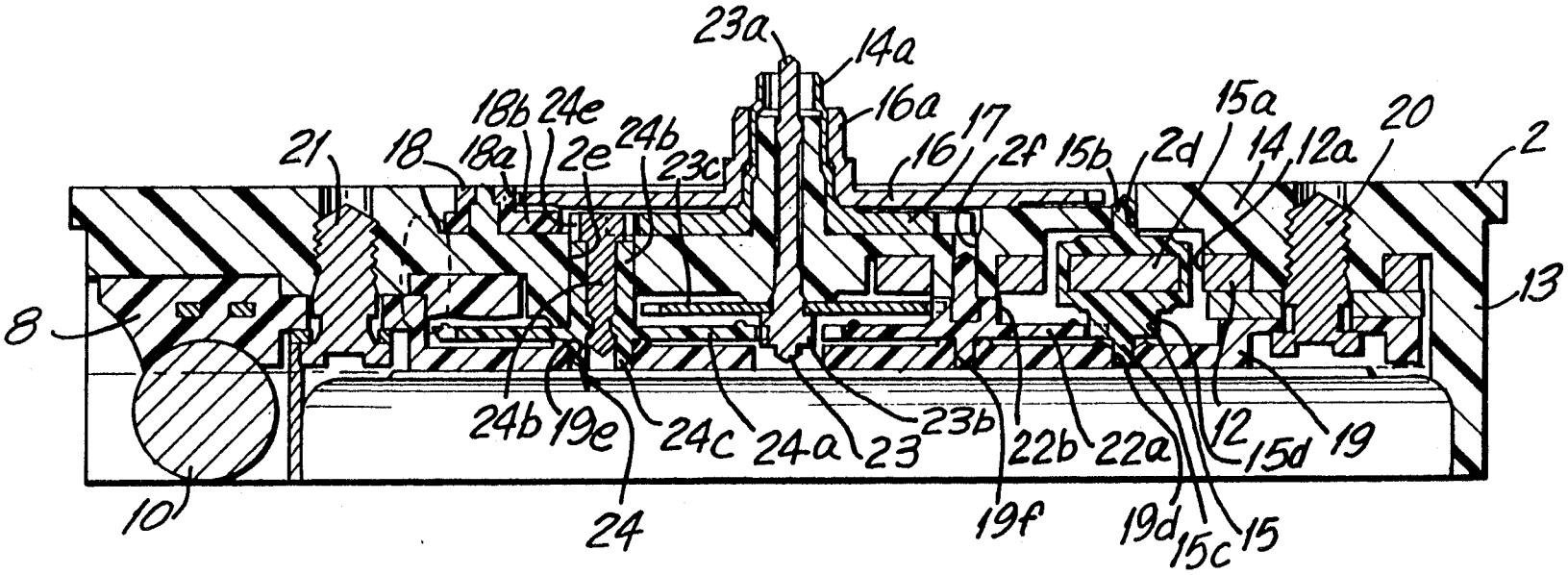
Figure 4:
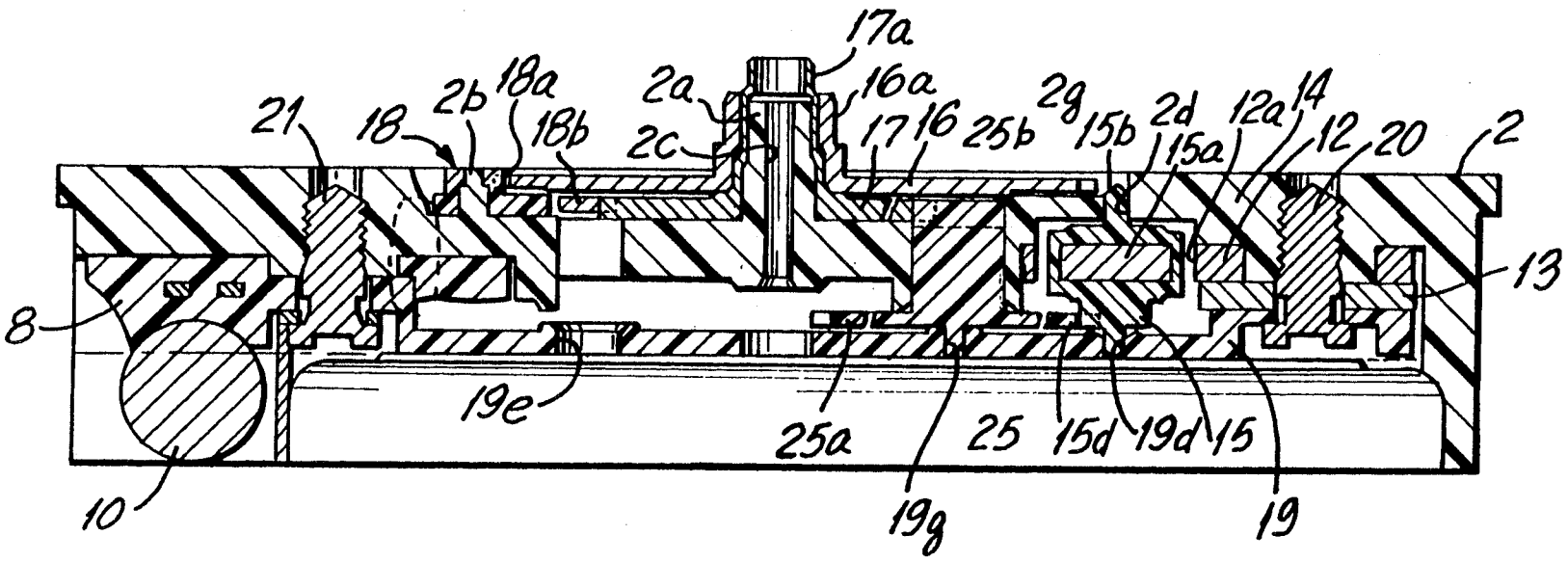

Lastly, the subassembly includes an insulating plastic bridge member 19 (seen only partially in FIGS. 1 and 2) held in place by screws 20, 21. Screw 20 also serves to hold stepping motor 3 in place, while screw 21 also serves to hold lead frame 8 in place. A fragment of bridge 19 can be seen at the location of each of the screws 20, 21. The complete bridge is seen in FIGS. 3 and 4.

As seen best in FIGS. 1, the "dial-side" gear train members are rotatably mounted on integral stubs which are part of frame 2. Hour wheel hub 16*a* and minute wheel hub 17*a* are coaxially disposed on a stub 2*a*. Stub 2*a* defines a central bore 2*c* coaxial therewith which will serve to journal the seconds spindle in the three hand timepiece but which will be empty in the two hand timepiece. The minute wheel assembly 18 is mounted on stub 2*b*.

Frame 2 is adapted to cooperate with either of two sets of wheel assemblies in accordance with the present invention. Frame 2 includes a number of bearings for rotatably journaling other gear train wheel assemblies to be described in detail, and a bore 2*d* for journaling the stepping motor rotor 15. The bearing for the wheel assemblies include a bore 2*e*, a bore 2*f*, and a bore 2*g*. The bores 2*f* and 2*g* appear to be almost on top of one another in FIG. 1, because they have been rotated into the plane of FIG. 1 and are almost at the same radius (see FIG. 2).

Frame 2 is preferably plastic and defines a contoured cavity for a large diameter, thin energy cell 30, preferably a lithium 3 V cell. A contoured peripheral wall 2*h* is provided in the frame, which wall is interrupted at various locations rather than forming a continuous sidewall. The lower boundary of the bridge 19 and top of cell 30, (not shown in FIG. 2) is indicated by the phantom line 31. Cell 30 is normally not considered part of the movement but is shown to illustrate how it fits in frame 2 against the bridge 19.

The plastic bridge member 19 serves to insulate the positive terminal of the energy cell 30 from the grounded (negative) metal components of the movement, as well as to provide bearings by means of bores coaxial with the aforementioned bores in the frame 2. The bores in the bridge 19 journal the lower ends of the rotatable wheel assembly members. In every case where such bores in bridge 19 are referred to, they will have the same lower case alphabetic designation as the corresponding coaxial bores in frame 2. Although not seen in FIGS. 1 and 2 the bridge includes bores 19*e*, 19*f*, 19*g* which can be seen in FIGS. 3 and 4.

The foregoing described elements 1–21 inclusive describe a movement subassembly comprising a first set of components common to both a two hand and a three hand timepiece in accordance with the present invention.

Three Hand Movement

Figure 5:
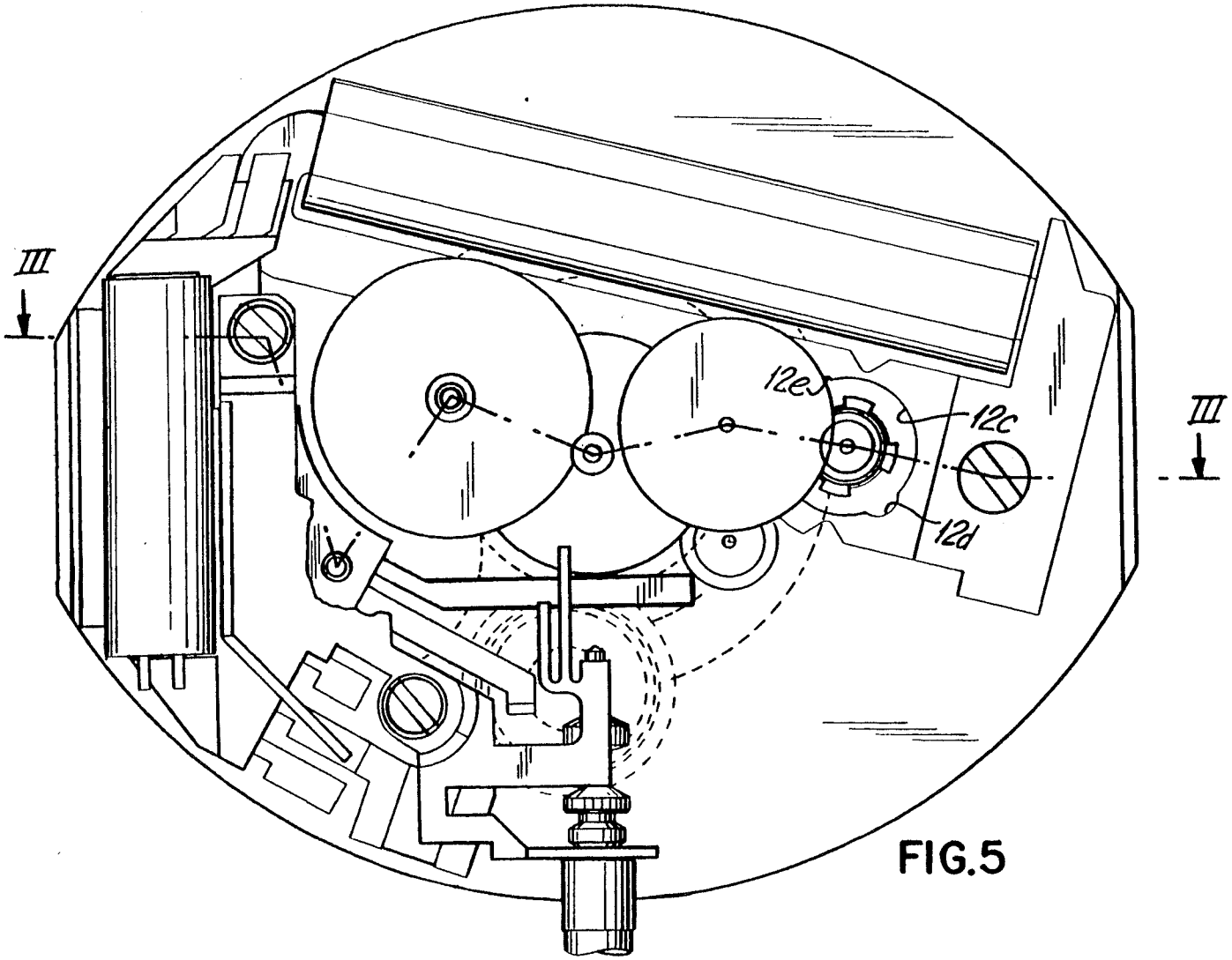

Referring now to FIGS. 3 and 5 of the drawing, the aforementioned common components in the first set of components are designated with the same reference numerals as before. The developed side elevation view is taken along the section line III—III indicated in the plan view of FIG. 5 which depicts a three hand timepiece corresponding to the elevation view of FIG. 3. The movement subassembly of FIGS. 1 and 2 is used to complete a three hand timepiece movement by adding a second set of components adapted to cooperate with the first set of common components, as follows. Referring to FIGS. 3 and 5 together, an intermediate wheel assembly 22 includes a toothed wheel 22*a* and a pinion 22*b*. Intermediate wheel assembly is rotatably journaled in coaxial bores 2*f*, 19*f* in the frame and bridge respectively. The next component in the second set of components is seconds wheel assembly 23. It includes a metal spindle 23*a* adapted to receive a seconds hand (not shown) at its upper end and a pinion 23*b* on its lower end. A toothed wheel 23*c* engages with and is driven by pinion 22*b* of the intermediate wheel assembly.

The integrated circuit 10 is adapted in the movement of FIGS. 3 and 5 to step the stepping motor rotor 15, one-half revolutions (180°) each step, at a high stepping rate, preferably once per second. The gear ratio providing a reduction through intermediate wheel assembly 22 to the wheel 23*c* is such as to rotate seconds spindle 23*a* once per minute, i.e., a 30:1 reduction from the rotor 15 to the seconds wheel assembly 22.

Gear reduction of the rotation of the seconds wheel assembly to the hour wheel 17 is accomplished by a third wheel assembly 24. The third wheel assembly includes a pinion and a toothed wheel which is made up from two components which are snap fit together to provide a slip coupling with friction drive. The slip coupling is for the purpose of setting the timepiece hands. A plastic toothed wheel 24*a* meshes with and is driven by pinion 23*b* of the seconds wheel assembly. Wheel 24*a* is integral with a plastic upper extension 24*b*, which is rotatably journaled in the bore 2*e* of the frame and a lower plastic extension 24*c* which is rotatably journaled in a coaxial bore 19*e* of the bridge. A metal stem 24*d* is inserted into extension 24*b* and includes a pinion 24*e* which meshes with and drives the toothed hour wheel 17. The third wheel assembly 24 has teeth size and pitch diameter such as to provide a total reduction of 60:1 between the seconds wheel assembly pinion 23 and center wheel 17.

By addition of the second set of components comprising intermediate wheel assembly 22, seconds wheel assembly 23 and third wheel assembly 24, as well as providing a higher rate integrated circuit pulsing, a three-hand movement is provided. The movement of FIGS. 3 and 5 may then be assembled into a three hand timepiece by adding case, dial, hands, and caseback (after inserting the energy cell as indicated in FIG. 3).

Two Hand Movement

Figure 6:
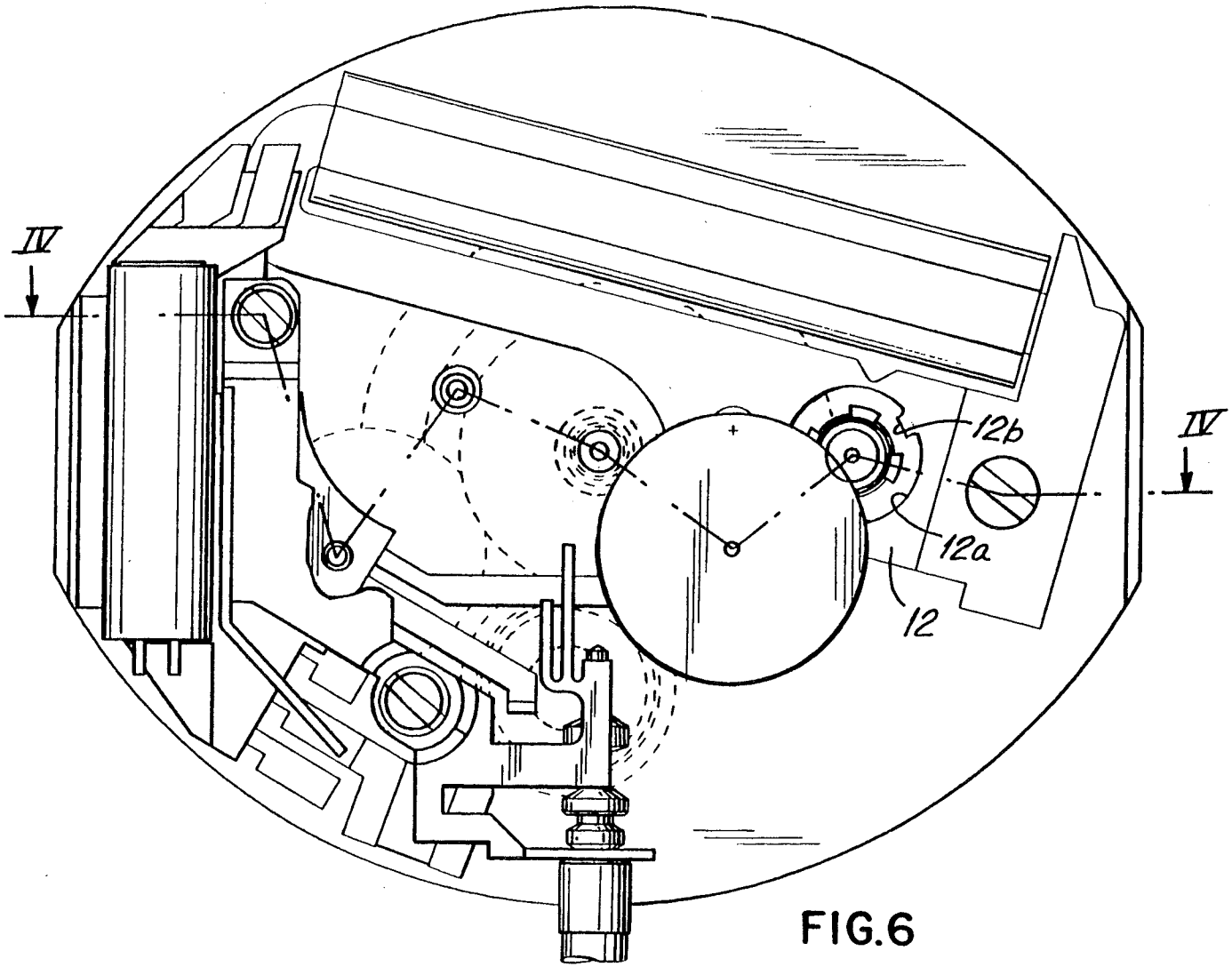

Referring now to FIGS. 4 and 6 of the drawing, there is seen a two hand timepiece movement which is completed by adding, to the subassembly of FIGS. 1 and 2, a third set of components in lieu of the aforementioned second set of components. The third set of components comprises a bypass wheel assembly 25 which performs a gear reduction directly between the stepping motor rotor 15 and center wheel 17. (The term "bypass wheel assembly" is used rather than a more customary term "intermediate wheel assembly" in order to avoid confusion with the intermediate wheel assembly 22 above.) The bypass wheel assembly 25 is rotatably journaled in coaxial opposed bores 2*g* and 19*g* in frame and bridge respectively, and comprises a single plastic molding having a toothed wheel 25*a* meshing with rotor pinion 15*d*, and a pinion 25*b* meshing with and driving center wheel 17.

The integrated circuit 10 is adapted to provide a lower rate pulsing, here one pulse per minute, to coil 14 of stepping motor 3. Each pulse steps the stepping motor rotor 15 one-half revolution (180°). The tooth size and pitch diameter of the gear reduction provided by bypass wheel assembly 25 is such as to rotate center wheel 17 once per minute. This reduction is the same as before, i.e. 30:1, except that in this case the wheel assembly couples the rotor 15 to the center wheel 17 rather than from stepping motor rotor to seconds wheel.

In order to complete the two hand timepiece, the movement of FIGS. 4 and 6 is assembled together with watch case, watch dial, hands, and, caseback, after inserting an energy cell as shown.

Figure 7:
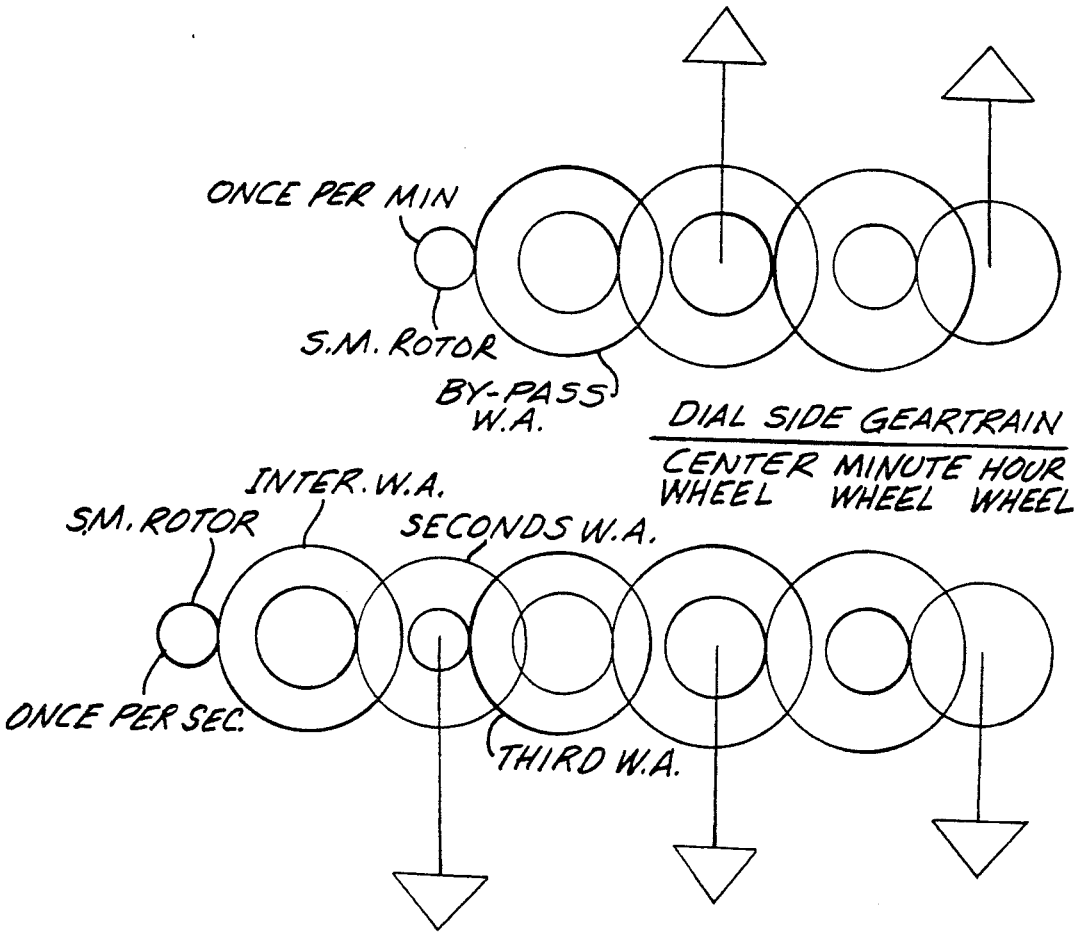

Referring to the simplified schematic drawing of FIG. 7, a representation of the timepiece gear trains is illustrated for the two hand and three hand timepiece. The gears are shown with the reduction proceeding from left to right without regard to actual location of the rotating components or the scale. The "dial side" gear train comprises the center wheel, minute wheel assembly and hour wheel with attached hour and minute hands. This assembly is identical in both timepieces and hence is part of the first set of components. In the two hand timepiece (upper part of the drawing), the stepping motor rotor stepped once per minute drives the center wheel through the by-pass reduction gear. In the three hand timepiece (lower part of the drawing), the stepping motor rotor driven once per second drives the intermediate wheel, which drives the seconds wheel, which drives the third wheel, which drives the center wheel.

While the invention is shown in its preferred form, the invention includes movements pulsing the stepping motor at intervals other then those indicated, by appropriate adjustment of the reduction between the stepping motor rotor pinion and the first driven wheel. For example, if the stepping motor rotor for the two hand timepiece is stepped twice per minute instead of once per minute, then the gear reduction supplied by the by-pass wheel assembly must be 60:1 rather than 30:1. Similarly, if in addition the three hand timepiece stepping motor rotor is pulsed twice per second, the reduction provided by the intermediate wheel assembly must also be 60:1. This will result in a physical rearrangement of elements, but the principle of the invention is the same.

The foregoing arrangements are faciliated by utilizing gears or rotating elements made of plastic material, which may pass through the stepping motor stator at appropriate locations as indicated in FIG. 3 without affecting the operation of the timepiece. The stator is provided with holes at the proper point aligned with the bearing bores and the plastic spindles will extend through these stator holes.

It will be understood that the lead frame 8 incorporates the integrated circuit 10. While the physical configuration and external envelope of the lead frame 8 is the same in both the two hand and three hand watch, the lead frame is termed a common part for the purpose of this application, since use of a modified 1C in the lead frame does not change the configuration of any of the other parts cooperating with it. Nevertheless the movements would require two separate part numbers because of the differences in the integrated circuit incorporated within the lead frame. In other words, the external appearance of the lead frame 8 is the same, but in one case, the integrated circuit provides pulses to the output terminals at a low rate (once per minute) and in the other case to the output terminals a high rate (once per second). However, it is quite possible to use a fully common part for the IC and lead frame and add a divider circuit on a separate PC board in the two hand timepiece to reduce the rate of output pulses.

Although the preferred embodiment has been shown with a lead frame, it is also within the purview of the present invention to use a printed circuit (PC) board to carry the integrated circuit 10, this being purely a matter of choice.

Also, for reasons not relevant to the present invention, it may be desirable to change the configuration of the hole 12*a* in the stator 12 by utilizing cutouts 12*d*, 12*e* rather than the projections 12*b*, 12*c* in the air gap to provide the rotor rest position. An altered configuration is shown in FIG. 5. In such case, there would actually be two different part numbers for the two hand stator and the three hand stator, but the external configuration would otherwise be the same. The selection of cutouts versus projections is a matter of choice and not relevant to the present invention.

While there has been described what is considered to be the preferred embodiment of the invention, other modifications will occur to those skilled in the art, and it is desired to secure in the appended claims all such modifications as fall within the true spirit and scope of the invention.

I claim:

1. A movement subassembly adapted for use in either a two hand timepiece or a three hand timepiece, said subassembly having a first set of elements common to both timepieces, said first set adapted to cooperate with a second set of components including at least an intermediate wheel assembly for a three hand timepiece, said first set also adapted to cooperate with a third set of components including at least a bypass wheel assembly for a two hand timepiece, wherein the improvement comprises a plurality of components in said first set adapted to cooperate either with said second set components or with said third set components.

2. The improvement according to claim 1, wherein the adaptation comprises a plurality of bearings provided in the first set for selectively rotatably mounting either of said wheel assemblies.

3. A movement subassembly adapted for use in either a two hand timepiece or a three hand timepiece, said subassembly having a first set of components common to both timepieces, comprising a frame, a stepping motor having a stator mounted in said frame, a dial-side gear train mounted in said frame including a center wheel adapted to carry a minute hand, an hour wheel adapted to carry an hour hand, and a minute wheel providing reduction between said center wheel and said hour wheel, said first set adapted to cooperate with a second set of components for a three hand timepiece, said second set of components comprising a seconds wheel adapted to carry a seconds hand, an intermediate wheel coupling the stepping motor rotor to said seconds wheel, a third wheel assembly coupling said seconds wheel to said center wheel, and an integrated circuit providing driving pulses at a high rate to said stepping motor, said first set also adapted to cooperate with a third set of components for a two hand timepiece, said third set of components comprising a bypass wheel assembly coupling said stepping motor rotor to said center wheel and an integrated circuit providing driving pulses at a low rate to said stepping motor, said frame of said first set being adapted to selectively rotatably mount the second wheel assembly, intermediate wheel assembly and third wheel assembly or to alternatively rotatably mount said bypass wheel assembly in said frame.

4. The combination according to claim 3, including a bridge attached to said frame, said frame and said bridge defining a plurality of pairs of coaxial bores in the frame and bridge respectively for rotatably journaling said wheel assemblies.

5. The combination according to claim 4, wherein said stator defines at least one stator hole aligned with one of said pairs of coaxial bores and wherein one of said wheel assemblies consists of nonmagnetic material and includes at least one spindle extending through said stator hole into one of said axial bores in said one pair.

6. The combination according to claim 5 wherein said dial side gear train is disposed on one side of said frame, and wherein said frame and said bridge are arranged to rotatably journal either the second or the third set of wheel assemblies therebetween on the other side of said frame.

7. The combination according to claim 3 wherein said second set's integrated circuit is arranged to provide one-per-second driving pulses to said stepping motor and wherein said third set's integrated circuit is arranged to provide once-per-minute driving pulses to said stepping motor.

* * * * *